US009782997B2

(12) United States Patent
Burke

(10) Patent No.: US 9,782,997 B2
(45) Date of Patent: Oct. 10, 2017

(54) RELIEF SCULPTURES AND RELATED METHODS

(71) Applicant: Marla Burke, Quakertown, PA (US)

(72) Inventor: Marla Burke, Quakertown, PA (US)

(73) Assignee: Marla Burke, Quakertown, PA (US)

( * ) Notice: Subject to any disclaimer, the term of this patent is extended or adjusted under 35 U.S.C. 154(b) by 37 days.

(21) Appl. No.: 14/936,180

(22) Filed: Nov. 9, 2015

(65) Prior Publication Data

US 2017/0129275 A1 May 11, 2017

(51) Int. Cl.

| | |
|---|---|
| ***B44C 1/10*** | (2006.01) |
| ***B44C 1/20*** | (2006.01) |
| ***B44C 3/04*** | (2006.01) |

(52) U.S. Cl.

CPC ..... *B44C 1/105* (2013.01); *B44C 1/20* (2013.01); *B44C 3/04* (2013.01); *B44C 3/042* (2013.01); *B44C 3/046* (2013.01)

(58) Field of Classification Search

CPC ..... B44C 1/105; B44C 3/042; B44C 3/048; B44C 3/046; B44C 1/18; B44C 1/20

See application file for complete search history.

(56) References Cited

U.S. PATENT DOCUMENTS

| | | | | |
|---|---|---|---|---|
| 2,656,634 | A | 10/1953 | Varner | |
| 3,634,951 | A * | 1/1972 | Knoll | G09B 29/12 434/152 |
| 3,772,106 | A | 11/1973 | Giorgi | |
| 6,228,427 | B1 | 5/2001 | Wanger | |
| 6,627,271 | B1 | 9/2003 | Okazaki | |
| 9,056,520 | B2 | 6/2015 | Cohen et al. | |
| 2014/0138019 | A1 | 5/2014 | Liu | |

FOREIGN PATENT DOCUMENTS

WO 91/17060 A1 11/1991

* cited by examiner

*Primary Examiner* — Christopher Schatz

(74) *Attorney, Agent, or Firm* — Muncy, Geissler, Olds & Lowe, P.C.

(57) ABSTRACT

Aspects of this disclosure relate generally to relief sculptures, and more particularly to methods of creating relief sculptures, kits for creating relief sculptures, and the relief sculptures themselves. A method may include, for example, contacting a transparent plate and a first surface of a pliable sheet, the first surface of the pliable sheet comprising an image, wherein at least a portion of the image is visible through the transparent plate, applying a sculpting medium to a portion of the transparent plate that corresponds to an image feature visible through the transparent plate, and adhering a second surface of the pliable sheet to the transparent plate, the sculpting medium, or both, such that the image feature corresponds to the sculpting medium.

12 Claims, 10 Drawing Sheets

RELIEF SCULPTURES AND RELATED METHODS

INTRODUCTION

Aspects of this disclosure relate generally to relief sculptures, and more particularly to methods of creating relief sculptures, kits for creating relief sculptures, and the relief sculptures themselves.

Artistic works such as paintings, prints, and photographs have long been created and displayed. These artistic works may include an image that is created on a flat support medium such as a wall, a wooden panel, or a sheet of paper or fabric. To create an image on the flat support medium, an artist or machine applies a medium such as paint or ink. Because the image is created on a flat support medium, the finished work generally lacks substantial visual depth.

A relief sculpture is a type of artistic work that may include a flat background and a raised portion. Relief sculptures are often carved into a sculpting medium such as stone or wood, or raised up from a flat support medium by applying layers of sculpting medium such as clay or plaster. Unlike paintings, prints, and photographs, which generally lack visual depth, relief sculptures are three-dimensional. However, when creating a relief sculpture, it may be difficult or time-consuming for the artist or machine to manipulate the sculpting medium as intended, and the relief sculpture may lack the detail of a painting, print, or photograph.

SUMMARY

The following summary is an overview provided solely to aid in the description of various aspects of the disclosure and is provided solely for illustration of the aspects and not limitation thereof.

In one example, a method of creating a relief sculpture is disclosed. The method may include, for example, contacting a transparent plate and a first surface of a pliable sheet, the first surface of the pliable sheet comprising an image, wherein at least a portion of the image is visible through the transparent plate, applying a sculpting medium to a portion of the transparent plate that corresponds to an image feature visible through the transparent plate, and adhering a second surface of the pliable sheet to the transparent plate, the sculpting medium, or both, such that the image feature corresponds to the sculpting medium.

In another example, a relief sculpture is disclosed. The relief sculpture may comprise, for example, a transparent plate, a sculpting medium contacting a portion of the transparent plate, a pliable sheet having a first surface comprising an image and a second surface that is adhered to the transparent plate, the sculpting medium, or both, wherein the image comprises an image feature that corresponds to the portion of the transparent plate to which the sculpting medium is applied.

In yet another example, a kit for creating a relief sculpture is disclosed. The kit may comprise, for example a transparent plate, sculpting medium, adhesive, and a pliable sheet having a first surface comprising an image, wherein the image is applied to the pliable sheet using one or more of direct-to-garment printing, silkscreening, thermal transfer, dye-sublimation printing, or any combination thereof.

BRIEF DESCRIPTION OF THE DRAWINGS

A more complete appreciation of embodiments of the invention and many of the attendant advantages thereof will be readily obtained as the same becomes better understood by reference to the following detailed description when considered in connection with the accompanying drawings which are presented solely for illustration and not limitation of the invention, and in which.

DETAILED DESCRIPTION

Various aspects of the disclosure are provided in the following description and related drawings directed to various examples provided for illustration purposes only. Alternate aspects may be devised without departing from the scope of the disclosure. Additionally, well-known aspects of the disclosure may not be described in detail or may be omitted so as not to obscure more relevant details.

Figure 1:
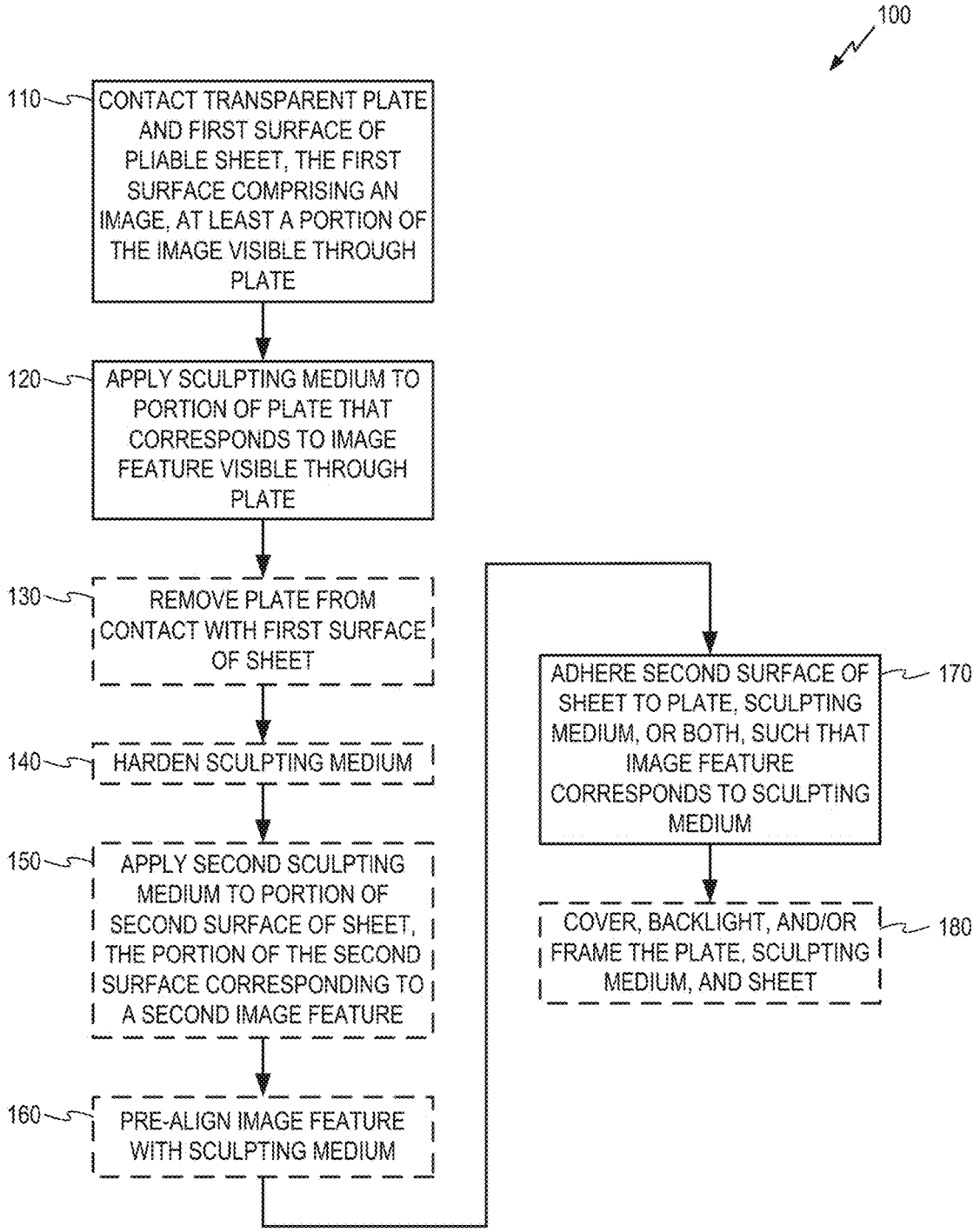
FIG. 1 illustrates a method for creating a relief sculpture in accordance with an aspect of the disclosure.

FIG. 1 illustrates a method 100 for creating a relief sculpture in accordance with some aspects of the disclosure. The method 100 will be described below as it would be performed by an artist. However, it will be understood that the method 100 (or any portion thereof) may be performed by a person, a machine, or a combination thereof. Moreover, the method 100 (or any portion thereof) may be performed with or without a tool or set of tools.

At 110, the artist contacts a transparent plate and a first surface of a pliable sheet, the first surface of the pliable sheet comprising an image, wherein at least a portion of the image is visible through the transparent plate. At 120, the artist applies a sculpting medium to a portion of the transparent plate that corresponds to an image feature visible through the transparent plate. At 130, the artist removes the transparent plate from contact with the first surface of the pliable sheet. At 140, the artist hardens the sculpting medium. At 150, the artist applies a second sculpting medium to a portion of the second surface of the pliable sheet, the portion of the second surface corresponding to a second image feature. At 160, the artist pre-aligns the image feature with the sculpting medium. At 170, the artist adheres a second surface of the pliable sheet to the transparent plate, the sculpting medium, or both, such that the image feature corresponds to the sculpting medium. At 180, the artist covers the pliable sheet with a transparent cover, applies a backlight to the transparent plate, and/or frames the transparent plate, sculpting medium, and pliable sheet.

Several of the actions depicted in FIG. 1 are optional. Optional actions are depicted with dashed lines. As an example, in some implementations of the method 100, one or more of the removing at 130, the hardening at 140, the applying at 150, the pre-aligning at 160, and the covering, backlighting, and/or framing at 180 may not be performed. Accordingly, in some aspects of the disclosure, the method 100 of creating a relief sculpture consists of contacting a transparent plate and a first surface of a pliable sheet, the first surface of the pliable sheet comprising an image, wherein at least a portion of the image is visible through the transparent plate, applying a sculpting medium to a portion of the transparent plate that corresponds to an image feature visible through the transparent plate, and adhering a second surface of the pliable sheet to the transparent plate, the sculpting medium, or both, such that the image feature corresponds to the sculpting medium.

In accordance with some aspects of the present disclosure, the pliable sheet having an image on a first surface thereof is provided to the artist prior to commencing performance of the method 100. Additionally or alternatively, the artist may create the image and apply the image to the pliable sheet prior to performing the method 100.

Figure 2:
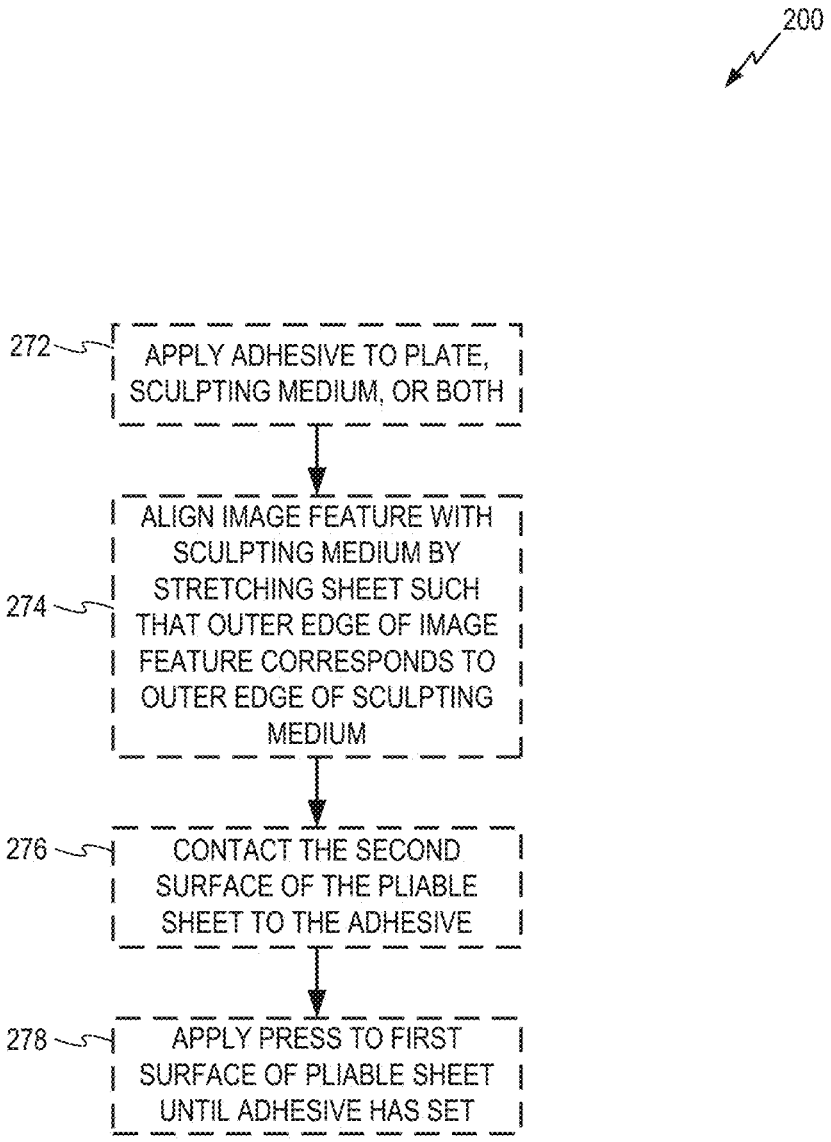
FIG. 2 illustrates a specific implementation of the method of FIG. 1 in accordance with an aspect of the disclosure.

FIG. 2 illustrates an adhering method 200 in accordance with some aspects of the disclosure. As noted above in the description of FIG. 1, the artist adheres at 170 a second surface of the pliable sheet to the transparent plate, the sculpting medium, or both, such that the image feature corresponds to the sculpting medium. In accordance with some aspects of the disclosure, the artist may use the adhering method 200 depicted in FIG. 2 to complete the adhering 170 of FIG. 1. The method 200 will be described below as it would be performed by an artist. However, it will be understood that the method 100 may be performed by a person, a machine, or both.

At 272, the artist applies adhesive to the transparent plate, the sculpting medium, or both. At 274, the artist aligns the image feature with the sculpting medium. At 276, the artist contacts the second surface of the pliable sheet to the adhesive. At 278, the artist applies a press to the first surface of the pliable sheet until the adhesive has set.

In accordance with some aspects of the disclosure, the applying of the adhesive at 272, the aligning at 274, the contacting at 276, and the applying of the press at 278 are optional. As an example, in some implementations of the method 200, one or more of the applying of the adhesive at 272, the aligning at 274, the contacting at 276, and the applying of the press at 278 may not be performed.

Moreover, although the applying of the adhesive at 272, the aligning at 274, the contacting at 276, and the applying of the press at 278 are depicted in FIG. 2 as occurring in a particular sequence, it will be understood that in accordance with some aspects of the disclosure, the applying of the adhesive at 272, the aligning at 274, the contacting at 276, and the applying of the press at 278 may be performed, in full or in part, in any order, and repeated, in full or in part, at any point in the sequence.

In accordance with some aspects of the disclosure, the applying of the adhesive at 272 includes applying a first adhesive to an outer edge of the sculpting medium and/or a portion of the transparent plate that is near the outer edge of the sculpting medium. The applying of the adhesive at 272 may further include applying a second adhesive to the transparent plate, the sculpting medium, or both. In accordance with some aspects of the disclosure, the second adhesive may have a lower water content than the first adhesive. As an example, water may be added to the second adhesive to create the first adhesive.

In accordance with some aspects of the disclosure, the aligning at 274 and contacting at 276 are performed by iteratively aligning a particular point on the pliable sheet with a corresponding point on the transparent plate or sculpting medium, stretching the pliable sheet such that a particular point on the pliable sheet reaches a corresponding point on the sculpting medium, positioning the pliable sheet such that the second surface of the pliable sheet contacts the adhesive applied at 272, and/or pressing the pliable sheet against the transparent plate or sculpting medium.

As will be understood from the foregoing, the pliable sheet may be stretchable in accordance with some aspects of the disclosure. Because the relief sculpture has depth, a surface area of the sculpting medium may exceed the surface area of the image feature to which the sculpting medium corresponds. Accordingly, a stretchable pliable sheet may facilitate alignment of the sculpting medium with the image feature to which the sculpting medium corresponds.

As noted above, the applying of the adhesive at 272, the aligning at 274, the contacting at 276, and the applying of the press at 278 may be performed, in full or in part, in any order, and repeated, in full or in part, at any point in the sequence. As an example, the adhesive may be applied at 272 to every exposed surface of the transparent plate and sculpting medium, after which incremental portions of the pliable sheet are aligned with corresponding areas of the transparent plate or sculpting medium and pressed against the adhesive. Depending on how quickly the adhesive sets, the aligning at 274 may be performed before the contacting at 276 (in the case of relatively quick-setting adhesive) or after the contacting at 276 (in the case of relatively slow-setting adhesive). The process of aligning at 274 and contacting at 276 may be repeated as necessary, for example, until the entire image portion of the pliable sheet has been adhered to the exposed surfaces of the transparent plate and sculpting medium.

As another example, the adhesive may be applied at 272 to an incremental portion of the transparent plate or sculpting medium, after which a corresponding portion of the pliable sheet is aligned at 274, contacted at 276, and pressed at 278. The process may be repeated as necessary for additional incremental portions.

In accordance with some aspects of the disclosure, the applying of the press at 278 may comprise applying a sandbag, a sheet of memory foam, or some other material that will conform to the shape of the relief sculpture. Additionally or alternatively, a weight may be placed on top of the sandbag or memory foam.

FIGS. 3A-3B, 4A-4B, 5A-5B, 6A-6B, 7A-7B, 8A-8B, 9A-9B, and 10A-10B depict a relief sculpture in various stages of creation in accordance with aspects of the disclosure. Although the various stages of creation are referred to as consecutive stages ("first", "second", etc.), it will be understood that no particular sequence is implied, and that any number of intermediate stages are possible between consecutive depictions. Although a relief sculpture may be created in accordance with FIGS. 3A-3B, 4A-4B, 5A-5B, 6A-6B, 7A-7B, 8A-8B, 9A-9B, and 10A-10B in the sequence presented, it will be understood that this is solely for the purposes of illustration, and that other sequences are possible in accordance with aspects of the disclosure. Moreover, it will be understood that the "first" stage of creation is merely the first stage of creation to be depicted for illustrative purposes in the present disclosure, and may be preceded by other stages of creation that are not depicted.

Figure 3A:
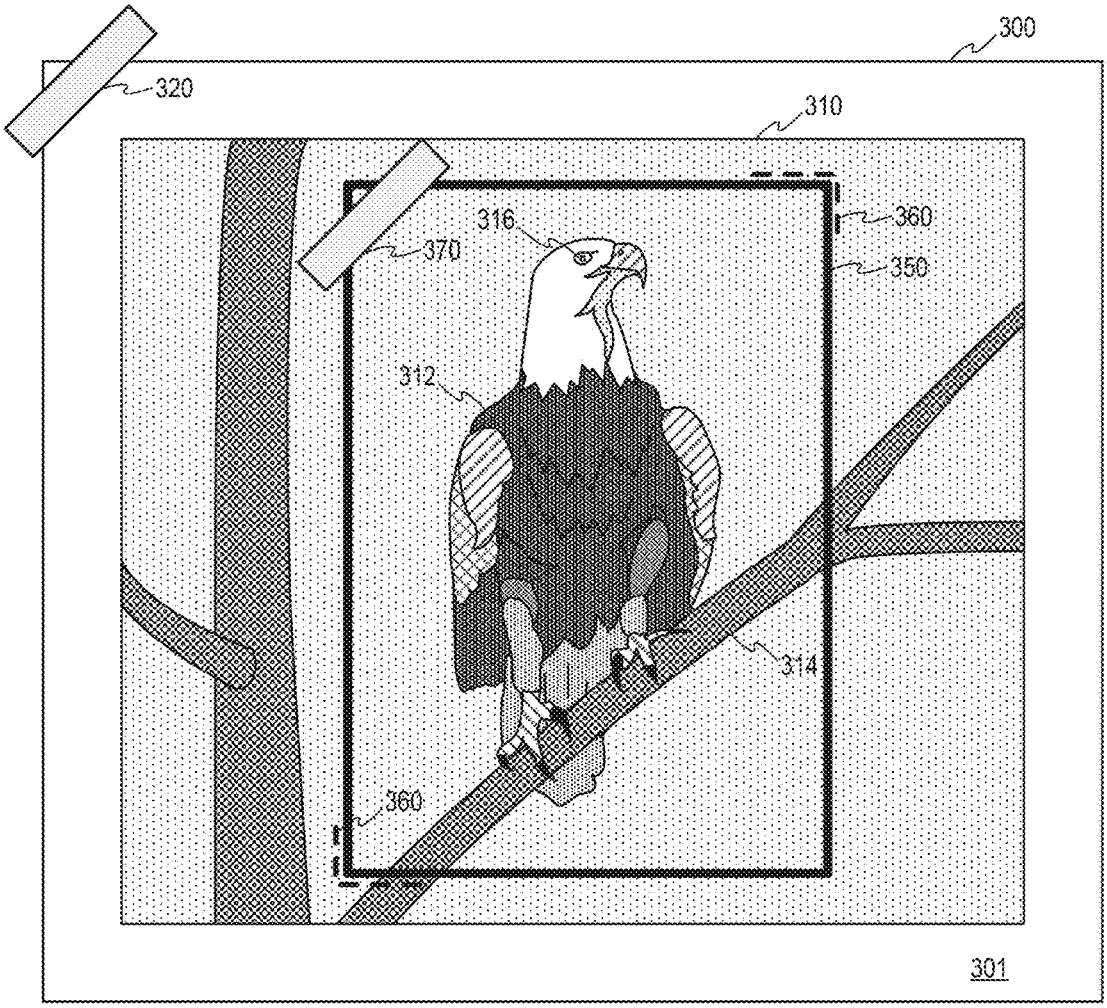
FIG. 3A illustrates a relief sculpture in a first stage of creation in accordance with an aspect of the disclosure.
Figure 3B:
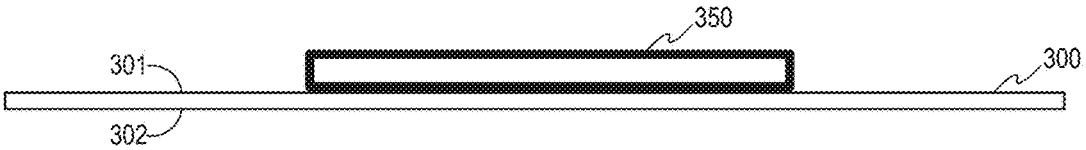
FIG. 3B illustrates a cross-sectional view of the relief sculpture depicted in FIG. 3A.

FIG. 3A illustrates a relief sculpture in a first stage of creation in accordance with aspects of the disclosure. FIG. 3B illustrates a cross-sectional view of the relief sculpture depicted in FIG. 3A. As an example, the first stage of creation depicted in FIGS. 3A-3B may correspond to the contacting 110 of FIG. 1, as described above.

FIG. 3A depicts a pliable sheet 300 having a first surface 301 and a second surface 302. The second surface 302 is not visible in the depiction of FIG. 3A, but is indicated in the cross-sectional view of FIG. 3B. The first surface 301 comprises an image 310, and the image 310 comprises a variety of image features. In FIG. 3A, three image features are indicated with particularity for purposes of illustration: an eagle image feature 312, a tree branch image feature 314, and an eagle eye image feature 316.

The pliable sheet 300 may be made of any suitable material. As an example, the pliable sheet 300 may comprise any combination of fabric, textile, canvas, paper, rubber, plastic, etc. The image 310 may be made of any suitable material. As an example, the image 310 may comprise any combination of ink, dye, paint, etc. The image 310 maybe a rendering of an artist, a photograph, a printed digital photograph, etc. In accordance with some aspects of the disclosure, the image 310 has been applied to the pliable sheet 300 using one or more of direct-to-garment printing, silkscreening, thermal transfer, dye-sublimation printing, or any combination thereof.

As noted above, the pliable sheet 300 having the image 310 on a first surface 301 may be provided to the artist prior to commencing performance of the method 100 depicted in FIG. 1. Additionally or alternatively, the artist may create the image 310 and apply the image 310 to the pliable sheet 300 prior to performing the method 100. As an example, the artist may capture a digital photograph to generate the image 310 and apply the image 310 to the first surface 301 of the pliable sheet 300 using dye-sublimation printing.

FIG. 3A also depicts a transparent plate 350. The transparent plate 350 may be made of any suitable material. As an example, the transparent plate 350 may comprise any combination of plastic, glass, etc. The transparent plate 350 need not be perfectly transparent, only sufficiently transparent that at least one image feature of the image 310 is visible or partially visible through the transparent plate 350. Although FIG. 3A depicts the transparent plate 350 as being smaller than the image 310 and the image 310 as being smaller than the pliable sheet 300, it will be understood that this is solely an example for purposes of illustration.

FIG. 3A also depicts an optional fastening element 320. The fastening element 320 may be applied to a portion of the pliable sheet 300 and may be configured to fasten the pliable sheet 300 to an underlying surface (not shown). The fastening element 320 may be made of any suitable material. As an example, the fastening element 320 may comprise tape, painter's tape, etc. The underlying surface to which the pliable sheet 300 is fastened may be a workbench or table. Additionally or alternatively, the underlying surface to which the pliable sheet 300 is fastened may be a rigid plate. In an example, the underlying surface is a plastic plate that is larger than the pliable sheet. The underlying surface may be light enough that it can be rotated by the artist or machine, but heavy enough that it does not rotate unintentionally.

FIG. 3A also depicts another optional fastening element 370. The fastening element 370 may be applied to a portion of the transparent plate 350 and may be configured to fasten the transparent plate 350 to the pliable sheet 300. The fastening element 370 may be made of any suitable material. As an example, the fastening element 370 may comprise tape, painter's tape, etc. Although FIG. 3A depicts two optional fastening elements 320 and 370, it will be understood that any number of fastening elements may be applied to the pliable sheet 300 and/or the transparent plate 350.

FIG. 3A also depicts optional alignment marks 360. The alignment marks 360 may, for example, indicate one or more outer edges of the transparent plate 350. Although FIG. 3A depicts two alignment marks 360, it will be understood that any number of alignment marks 360 may be applied to the pliable sheet 300 and/or the image 310. As an example, the alignment marks 360 may be marked by applying dashed lines with a permanent marker to the top-right and bottom-left corners of the transparent plate 350, as depicted in FIG. 3A. However, it will be understood that the alignment marks 360 may be marked in any suitable manner.

Figure 4A:
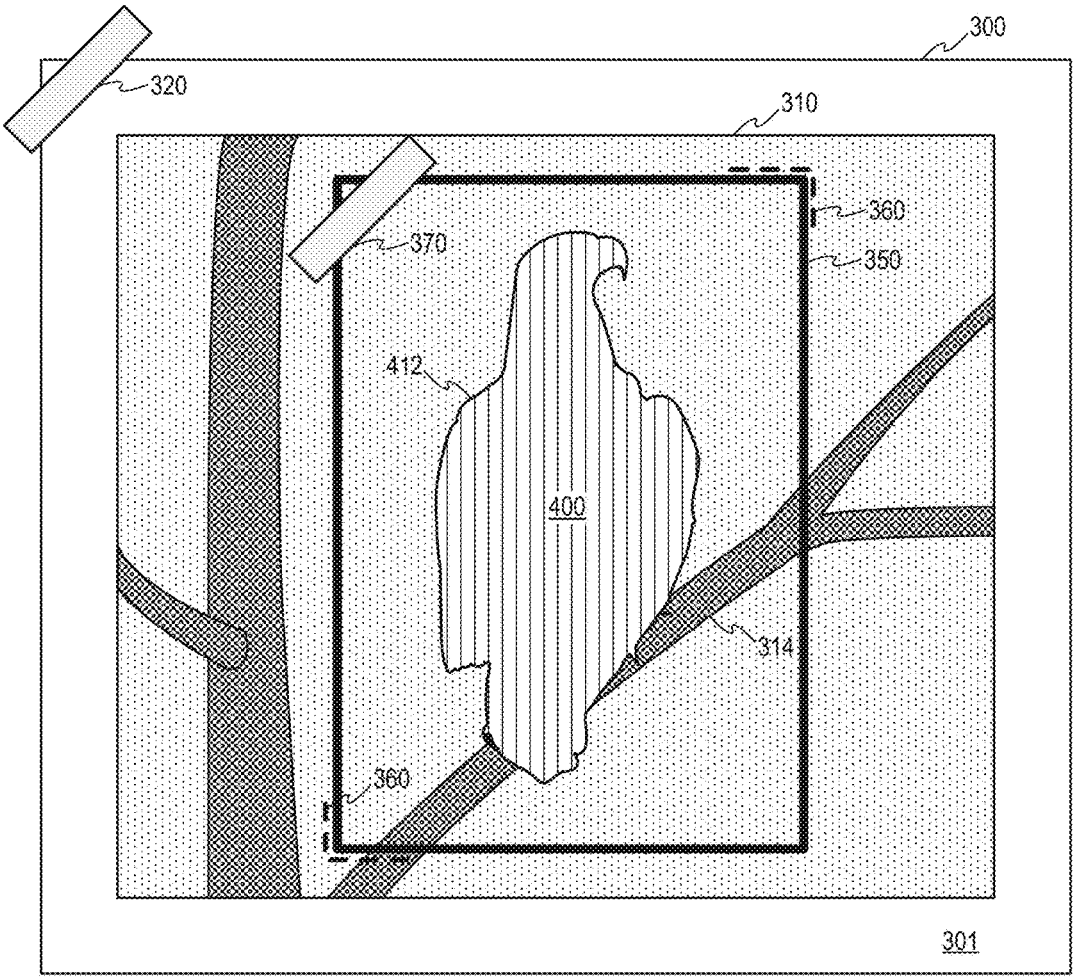
FIG. 4A illustrates a relief sculpture in a second stage of creation in accordance with an aspect of the disclosure.
Figure 4B:
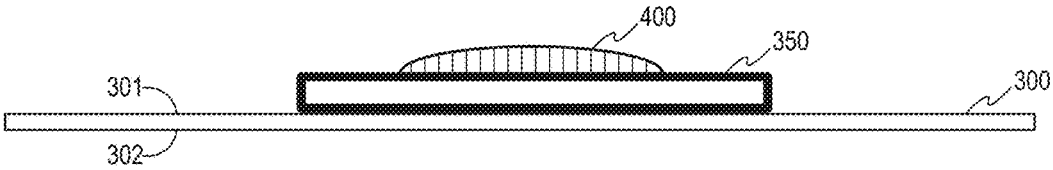
FIG. 4B illustrates a cross-sectional view of the relief sculpture depicted in FIG. 4A.

FIG. 4A illustrates a relief sculpture in a second stage of creation in accordance with an aspect of the disclosure. FIG. 4B illustrates a cross-sectional view of the relief sculpture depicted in FIG. 4A. As an example, the second stage of creation depicted in FIGS. 4A-4B may correspond to the applying 120 of FIG. 1, as described above.

As depicted in FIGS. 4A-4B, sculpting medium 400 may be applied to the transparent plate 350. As an example, the eagle image feature 312 depicted in FIG. 3A has been selected by the artist as a subject of the relief sculpture. Accordingly, the sculpting medium 400 may be applied to a selected portion 412 of the transparent plate 350 that corresponds to the eagle image feature 312. As used herein, correspondence may refer to, for example, a positional correspondence between the different layers of material used to make the relief sculpture. As can be understood by a comparison of FIG. 4A to FIG. 3A, the transparent plate 350 may be placed on top of the pliable sheet 300, and the sculpting medium 400 may be placed in vertical positional correspondence with the selected image feature.

In some implementations, the artist may duplicate or photocopy the image 310 to use as a reference while applying the sculpting medium 400. Because it is scaled properly, a duplicate or photocopy of the image 310 may be preferable to using, for example, an original photograph upon which the image 310 is based. Alternatively or additionally, the artist may use a sculpting medium 400 that is at least partially transparent, thereby enabling the artist to view the features in the image 310 directly through the sculpting medium 400.

In some implementations, the artist may apply to the sculpting medium 400 to a specific portion of the pliable sheet 300 corresponding to an opening in a frame or frame matting associated with the frame. Accordingly, the artist may restrict application of the sculpting medium 400 to the specific portion of the pliable sheet 300 corresponding to the opening in the frame or frame matting.

As depicted in FIG. 4A, the optional fastening elements 320 and/or 370 may be used to preserve the alignment of the pliable sheet 300 and/or transparent plate 350 with respect to one another and/or an underlying surface. The preservation of the alignment may facilitate effective application of the sculpting medium 400 to the selected portion 412 of the transparent plate 350.

In this example, the tree branch image feature 314 has not been selected by the artist as a subject of the relief sculpture, and the sculpting medium 400 has not been applied to portions of the transparent plate 350 that correspond to the tree branch image feature 314. However, it will be understood that the artist may arbitrarily select which of the image features in the image 310 will be subjects of the relief sculpture.

Although FIG. 4A depicts the sculpting medium 400 as being confined to a single contiguous portion of the transparent plate 350, it will be understood that this is solely an example for purposes of illustration. The sculpting medium 400 may be applied to the entirety of the transparent plate 350, or to two or more non-contiguous portions of the transparent plate 350.

As shown in FIG. 4B, the thickness of the sculpting medium 400 may vary. As an example, the sculpting medium 400 may have a relatively shallow depth corresponding to the edges of the selected portion 412 and a relatively deep depth corresponding to the center of the selected portion 412. In other aspects of the present disclosure, the sculpting medium 400 may have equal depth across the entirety of the selected portion 412. In yet other aspects of the present disclosure, the depth of the sculpting medium 400 may be varied in correspondence with image details of the selected image feature. As an example, the artist may choose to accentuate certain details of the eagle image feature 312, for example, the beak, the breast, or the talons. The sculpting medium 400 may be applied such that a sharp change in depth of the sculpting medium 400 corresponds to the position of the eagle's beak and talons, and a deep depth of the sculpting medium 400 corresponds to the puffed-out breast of the eagle.

The sculpting medium 400 may comprise any suitable material. As an example, the sculpting medium 400 may comprise any combination of clay, fabric paint, fabric ink, wood, wax, foam, glass, plastic, three-dimensional printing medium, etc. The sculpting medium 400 may be layered onto the selected portion 412 of the transparent plate 350 until the sculpting medium 400 has been applied to the desired depth throughout the selected portion 412. As an example, clay, fabric paint, fabric ink, or wax may be applied in lumps or layers and molded or chiseled away as desired. Additionally or alternatively, the sculpting medium 400 may comprise a sheet of foam, wood, or plastic that is cut so as to be shaped similarly to the selected image feature. Additionally or alternatively, the sculpting medium 400 may not need to be molded or formed. As an example, an appropriately-sized piece of glass or wood may be selected by the artist and used by the artist as the sculpting medium 400. Additionally or alternatively, the sculpting medium 400 may be a three-dimensional printing medium, the shape of which is selected by the artist and printed using a three-dimensional printer. In some aspects of the disclosure, the image 310 is derived from a digital photograph, and the digital photograph is also used to generate the shape of the three-dimensional printing medium.

Figure 5A:
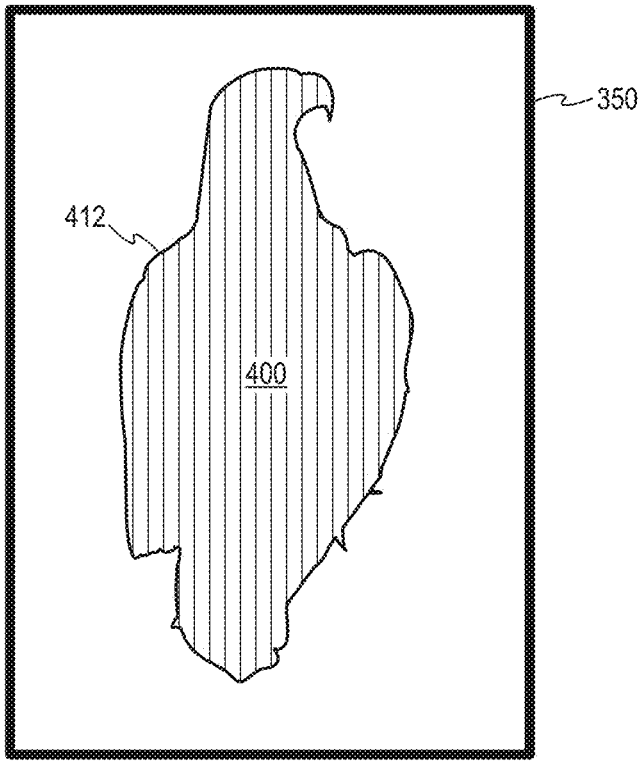
FIG. 5A illustrates a relief sculpture in a third stage of creation in accordance with an aspect of the disclosure.
Figure 5B:
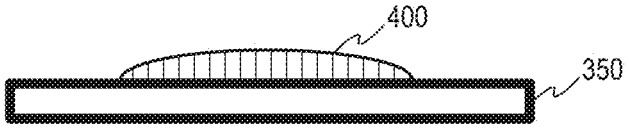
FIG. 5B illustrates a cross-sectional view of the relief sculpture depicted in FIG. 5A.

FIG. 5A illustrates a relief sculpture in a third stage of creation in accordance with an aspect of the disclosure. FIG. 5B illustrates a cross-sectional view of the relief sculpture depicted in FIG. 5A. As an example, the third stage of creation depicted in FIGS. 5A-5B may correspond to the optional removing at 130 of FIG. 1 and/or the optional hardening at 140 of FIG. 1, as described above.

In accordance with some aspects of the disclosure, it may be necessary to remove the pliable sheet 300 (as at 130) in order to harden the sculpting medium 400 (as at 140). As an example, the artist may choose to harden the sculpting medium 400 in an oven and may remove the pliable sheet 300 prior to hardening the sculpting medium 400.

In accordance with some aspects of the disclosure, the sculpting medium 400 is modified after hardening (as at 140). The modification may include sanding, scraping, etc., with a suitable tool. Moreover, the modification may include application of additional sculpting medium 400.

Figure 6A:
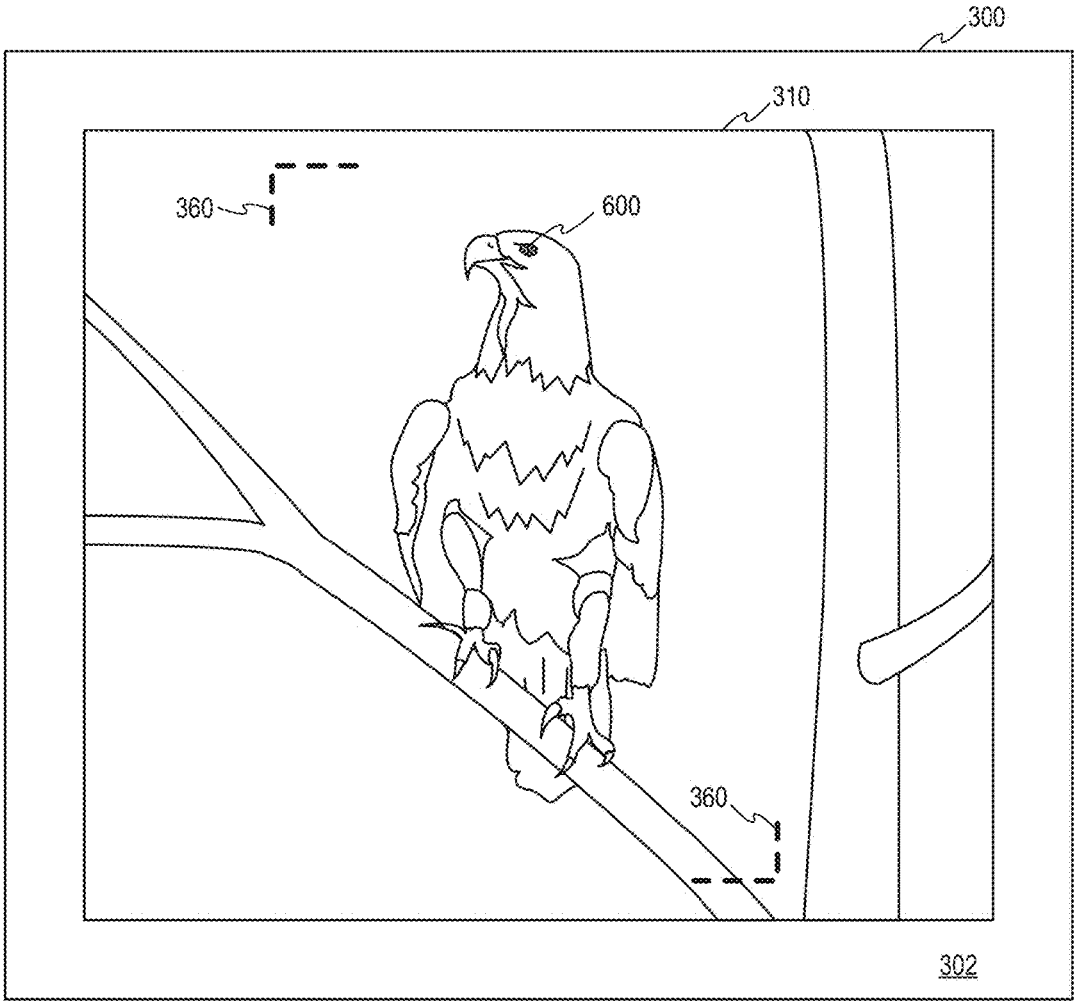
FIG. 6A illustrates a relief sculpture in a fourth stage of creation in accordance with an aspect of the disclosure.
Figure 6B:
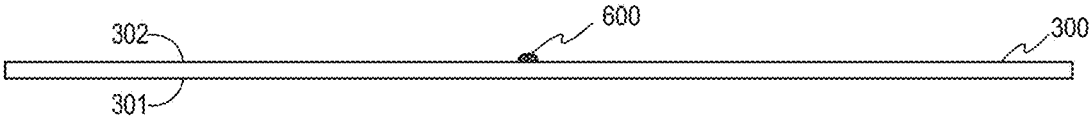
FIG. 6B illustrates a cross-sectional view of the relief sculpture depicted in FIG. 6A.

FIG. 6A illustrates a relief sculpture in a fourth stage of creation in accordance with an aspect of the disclosure. FIG. 6B illustrates a cross-sectional view of the relief sculpture depicted in FIG. 6A. As an example, the fourth stage of creation depicted in FIGS. 6A-6B may correspond to the optional applying of the second sculpting medium at 150 of FIG. 1, as described above.

In FIGS. 6A-6B, second sculpting medium 600 has been applied to the pliable sheet 300. As an example, the eagle eye image feature 316 depicted in FIG. 3A has been selected by the artist as an additional subject of the relief sculpture. Accordingly, the second sculpting medium 600 may be applied to a selected portion of the pliable sheet 300 that corresponds to the eagle eye image feature 316. In accordance with some aspects of the disclosure, the second sculpting medium 600 may be applied to the first surface 301 of the pliable sheet 300, the second surface 302 of the pliable sheet 300, or both. In FIGS. 6A-6B, the second sculpting medium 600 has been applied to the second surface 302, although it will be understood that this is an example provided solely for illustrative purposes.

In order to place the second sculpting medium 600 in a position that corresponds to the selected image feature (the eagle eye image feature 316 in this example), the artist may 'feel' the position of the eagle eye image feature 316 through the pliable sheet 300, for example, by placing a finger or tool on or through the eagle eye image feature 316, turning the pliable sheet 300 such that it is draped over the finger or tool, and placing the second sculpting medium 600 in a position that corresponds to the point of the finger or tool. Additionally or alternatively, if the pliable sheet 300 is transparent or semi-transparent, the mirror image of the image 310 can be viewed through the second surface 302 and the second sculpting medium 600 placed in correspondence with the selected image feature. In an example, the pliable sheet 300 may be placed on a backlight or backlight table such that the mirror image of the image 310 can be viewed through the second surface 302.

In accordance with some aspects of the disclosure, the second sculpting medium 600 is applied for the purpose of accenting the finer details of the relief sculpture, whereas the sculpting medium 400 is applied for the coarser details of the relief sculpture. As an example, the coarser details may be sculpted using modeling clay as the sculpting medium 400 and the finer details may be sculpted using fabric ink as the second sculpting medium 600. Although the eagle eye image feature 316 is entirely within the eagle image feature 312, it will be understood that this is an example provided solely for illustrative purposes. The second sculpting medium 600 may be applied such that it overlaps entirely with the sculpting medium 400, such that it overlaps partially with the sculpting medium 400, or such that it does not overlap with the sculpting medium 400 at all. Moreover, the second sculpting medium 600 may be substituted for the sculpting medium 400 in whole or in part.

Figure 7A:
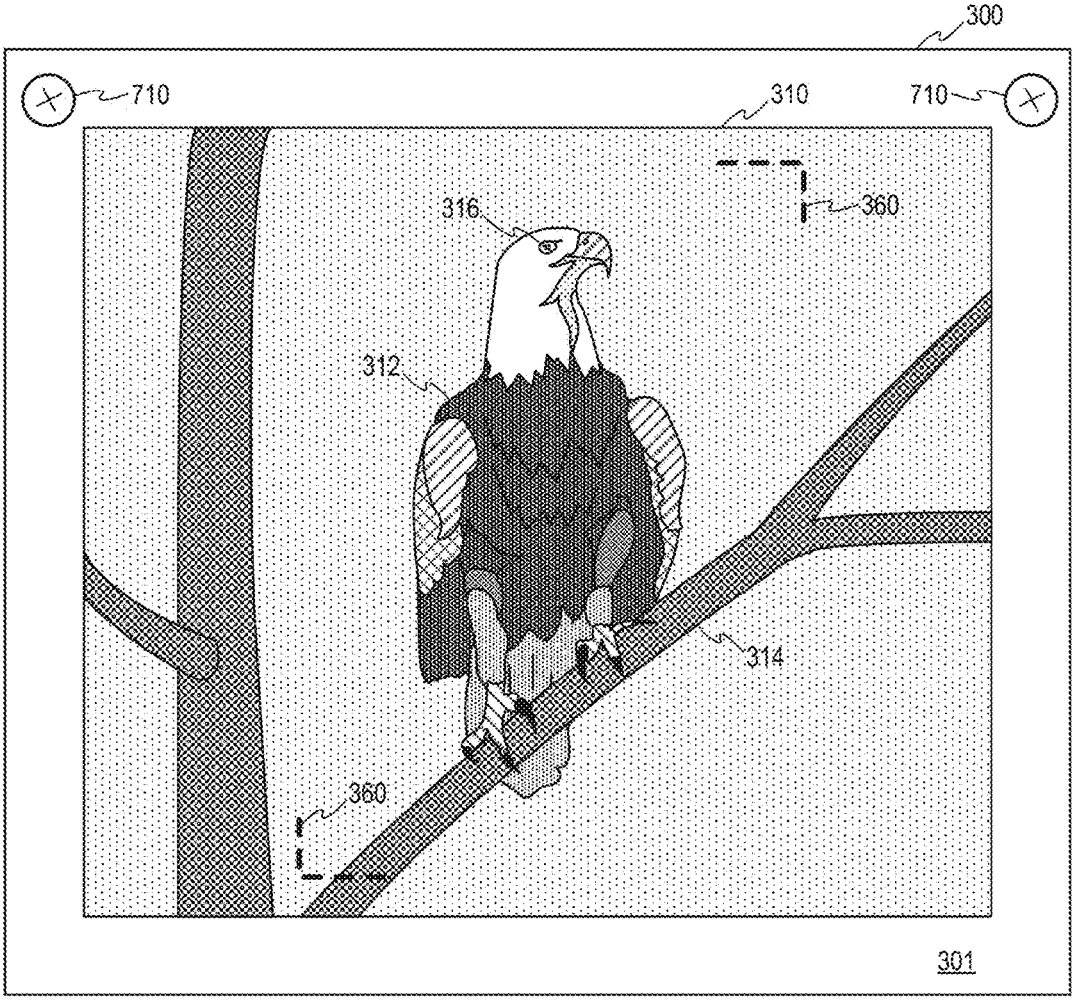
FIG. 7A illustrates a relief sculpture in a fifth stage of creation in accordance with an aspect of the disclosure.
Figure 7B:
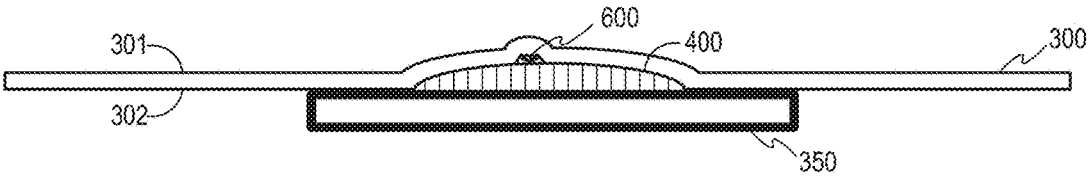
FIG. 7B illustrates a cross-sectional view of the relief sculpture depicted in FIG. 7A.

FIG. 7A illustrates a relief sculpture in a fifth stage of creation in accordance with an aspect of the disclosure. FIG. 7B illustrates a cross-sectional view of the relief sculpture depicted in FIG. 7A. As an example, the fifth stage of creation depicted in FIGS. 7A-7B may correspond to the optional pre-aligning at 160 of FIG. 1, as described above.

In FIG. 7A, the second surface 302 of the pliable sheet 300 is placed in contact with the transparent plate 350, the sculpting medium 400, or both. Moreover, the pliable sheet 300 is positioned such that the image features selected by the artist as the subjects of the relief sculpture are aligned with the sculpting medium 400.

As shown above in FIG. 3A, alignment marks 360 may be added to the pliable sheet 300 when the first surface 301 of the pliable sheet 300 is in contact with the transparent plate 350. It will be understood that the alignment marks 360 applied when the first surface 301 of the pliable sheet 300 is in contact with the transparent plate 350 may be used to pre-align the pliable sheet 300 when the second surface 302 of the pliable sheet 300 is in contact with the transparent plate 350.

FIG. 7A also shows anchor points 710. In accordance with some aspects of the disclosure, each anchor point 710 represents a position of an anchoring element for immobilizing the pliable sheet 300 with respect to an anchor object (not shown). The anchoring element may be, for example, a pin, clamp, weight, or any combination thereof. The anchor object may be, for example, a workbench or table. Although two circular anchor points 710 are depicted in FIG. 7A, it will be understood that this is an example provided solely for illustrative purposes. The anchor points 710 may have any number (including zero) and each of the anchor points 710 may be of any shape or size.

As shown in FIGS. 7A-7B, the artist may pre-align the pliable sheet 300 such that the image features selected by the artist as the subjects of the relief sculpture are aligned with the sculpting medium 400. As an example, the pliable sheet 300 may be positioned such that the eagle image feature 312 corresponds to the sculpting medium 400. As noted above, the artist may use the alignment marks 360 to facilitate the alignment. Once the image features selected by the artist as the subjects of the relief sculpture are aligned with the sculpting medium 400, the artist may then immobilize the pliable sheet 300 by applying an anchoring element to the pliable sheet 300 at one or more of the anchor points 710.

In some implementations, the artist may further mold the sculpting medium 400 after performing the pre-aligning shown in FIGS. 7A-7B. For example, the artist may add certain details to the shape of the sculpting medium 400 by pressing through the pre-aligned pliable sheet 300. It will be understood that this molding may be performed prior to hardening of the sculpting 400, if such hardening is necessary.

Figure 8A:
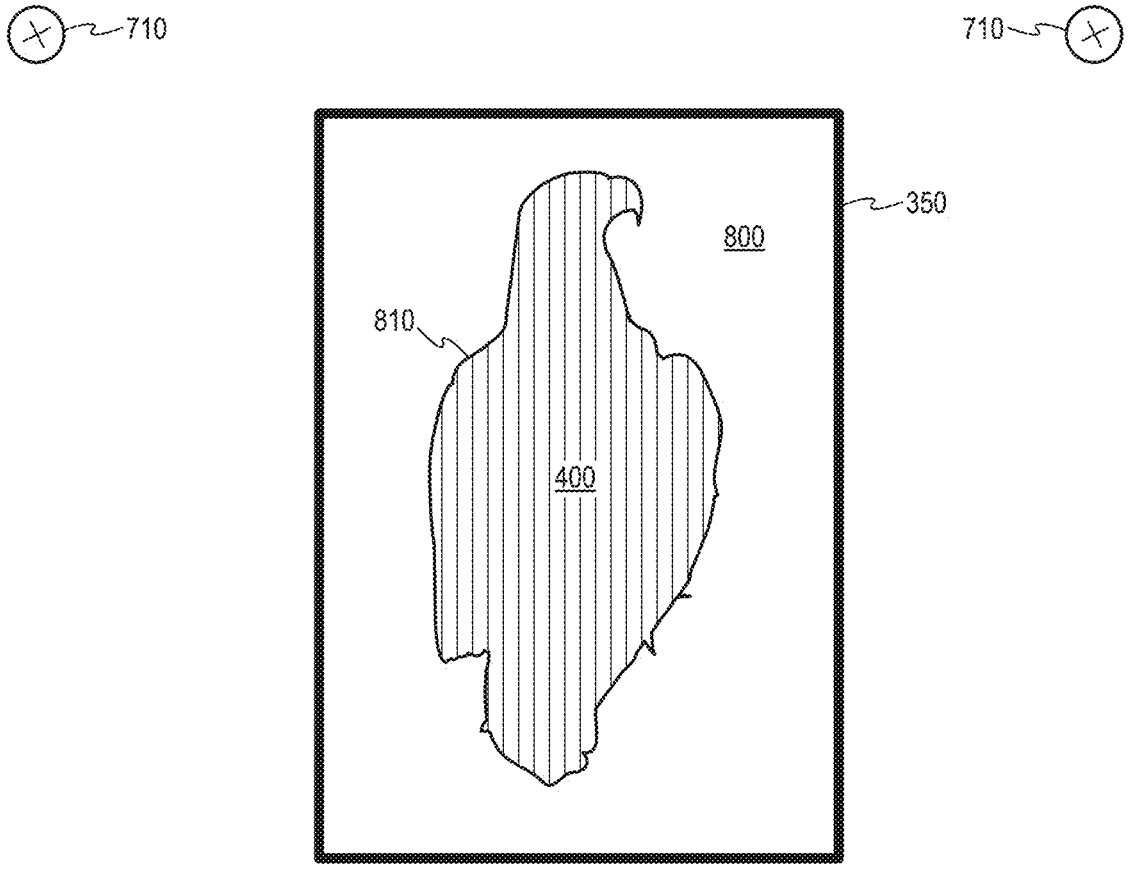
FIG. 8A illustrates a relief sculpture in a sixth stage of creation in accordance with an aspect of the disclosure.
Figure 8B:
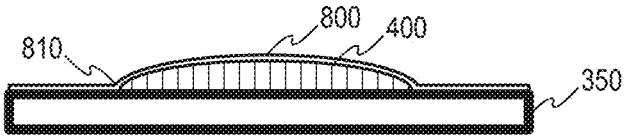
FIG. 8B illustrates a cross-sectional view of the relief sculpture depicted in FIG. 8A.

FIG. 8A illustrates a relief sculpture in a sixth stage of creation in accordance with an aspect of the disclosure. FIG. 8B illustrates a cross-sectional view of the relief sculpture depicted in FIG. 8A. As an example, the sixth stage of creation depicted in FIGS. 8A-8B may correspond to the adhering at 170 of FIG. 1 (as described above) and/or the applying of adhesive at 272 of FIG. 2 (as described above).

In FIGS. 8A-8B, adhesive 800 is shown. Although the adhesive 800 covers the entire exposed surface of the transparent plate 350 and sculpting medium 400, it will be understood that this is an example provided solely for illustrative purposes. In accordance with some aspects of the disclosure, the adhesive 800 is applied to a portion of the exposed surface of the transparent plate 350 and/or a portion of the exposed surface of the sculpting medium 400. The adhesive 800 may include any suitable material. As an example, the transparent plate 350 may comprise cement, epoxy, paste, glue, resin, sealant, etc. As an example, a sealant such as LocTite Tub & Tile 2 in 1™ may be used as the adhesive 800.

The adhesive 800 shown in FIG. 8A may include and/or consist of a first adhesive 810 and a second adhesive. As noted above in the description of FIG. 2, the applying of adhesive at 272 may include applying of the first adhesive 810 to an outer edge of the sculpting medium and a portion of the transparent plate that is near the outer edge of the sculpting medium. In accordance with some aspects of the disclosure, the first adhesive 810 may be applied with a finger or tool by running the finger or tool along an edge of the sculpting medium 400, thereby spreading the first adhesive 810 along the selected edge. The first adhesive 810 may be applied to a portion of the edge of the sculpting medium 400 or the entirety thereof. The second adhesive may comprise the remaining portions of the adhesive 800, i.e., the portions of the adhesive 800 that are not applied to an edge of the sculpting medium 400.

In accordance with some aspects of the disclosure, the first adhesive 810 may be used to immobilize the sculpting medium 400 with respect to the transparent plate 350 after the sculpting medium 400 has been applied to the transparent plate 350 (for example, after completing the applying of the sculpting medium 400 at 120). In some scenarios, the first adhesive 810 may be used to prevent the sculpting medium 400 from warping as it hardens or dries (for example, due to shrinking of the sculpting medium 400). Accordingly, the first adhesive 810 may be applied prior to, for example, the hardening at 140.

The second adhesive may be applied to the remaining areas of the transparent plate 350 and/or the sculpting medium 400. Additionally or alternatively, the second adhesive may be applied on top of the first adhesive 810. If the first adhesive 810 is applied, the first adhesive 810 may or may not be permitted to dry prior to application of the second adhesive. In accordance with some aspects of the disclosure, the first adhesive 810 may have a higher water content than the second adhesive. As an example, water may be added to the second adhesive to create the first adhesive 810.

FIG. 8A also shows the anchor points 710. As noted above, the anchor points 710 may be used to immobilize the pliable sheet 300 with respect to an anchor object such as a workbench or table. In accordance with some aspects of the disclosure, the pliable sheet 300 is immobilized via the anchor points 710 for pre-aligning (for example, the pre-aligning at 160) and rolled back such that at least a portion of the transparent plate 350, the sculpting medium 400, or both, is exposed.

It will be understood that by placing the anchor points 710 on a same side of the transparent plate 350 beyond the periphery of the transparent plate 350, the pliable sheet 300 can be rolled back to expose the entirety of the transparent plate 350 and sculpting medium 400. After the second surface 302 of the pliable sheet 300 is removed from contact with at least a portion of the transparent plate 350 and/or sculpting medium 400, that portion of the transparent plate 350 and/or sculpting medium 400 is exposed, thereby facilitating the application of the adhesive 800. The pre-aligned pliable sheet 300 can thereafter be rolled back down and adhered to the transparent plate 350 and/or sculpting medium 400.

It will be further understood that the anchor points 710 need not be placed as shown in FIG. 8A. In an example, one or more anchor points 710 may, additionally or alternatively, be placed on a portion of the pliable sheet 300 that corresponds to the transparent plate 350 and/or sculpting medium 400. As an example, the anchor points 710 may be placed on a portion of the pliable sheet 300 that has already been adhered to the transparent plate 350 and/or sculpting medium 400.

It will be further understood that the anchor points 710 may be moved at any time. In an example, the anchor points 710 may be placed as shown in FIG. 8A while an upper portion of the pliable sheet 300 (i.e., a portion towards the top of FIG. 8A) is adhered to an upper portion of the transparent plate 350 and/or sculpting medium 400. Then, one or more of the anchor points 710 may be moved downward to facilitate adhering of a lower portion of the pliable sheet 300 to a lower portion of the transparent plate 350 and/or sculpting medium 400. Alternatively, rather than moving one or more of the anchor points 710, one or more additional anchor points 710 may be added.

Figure 9A:
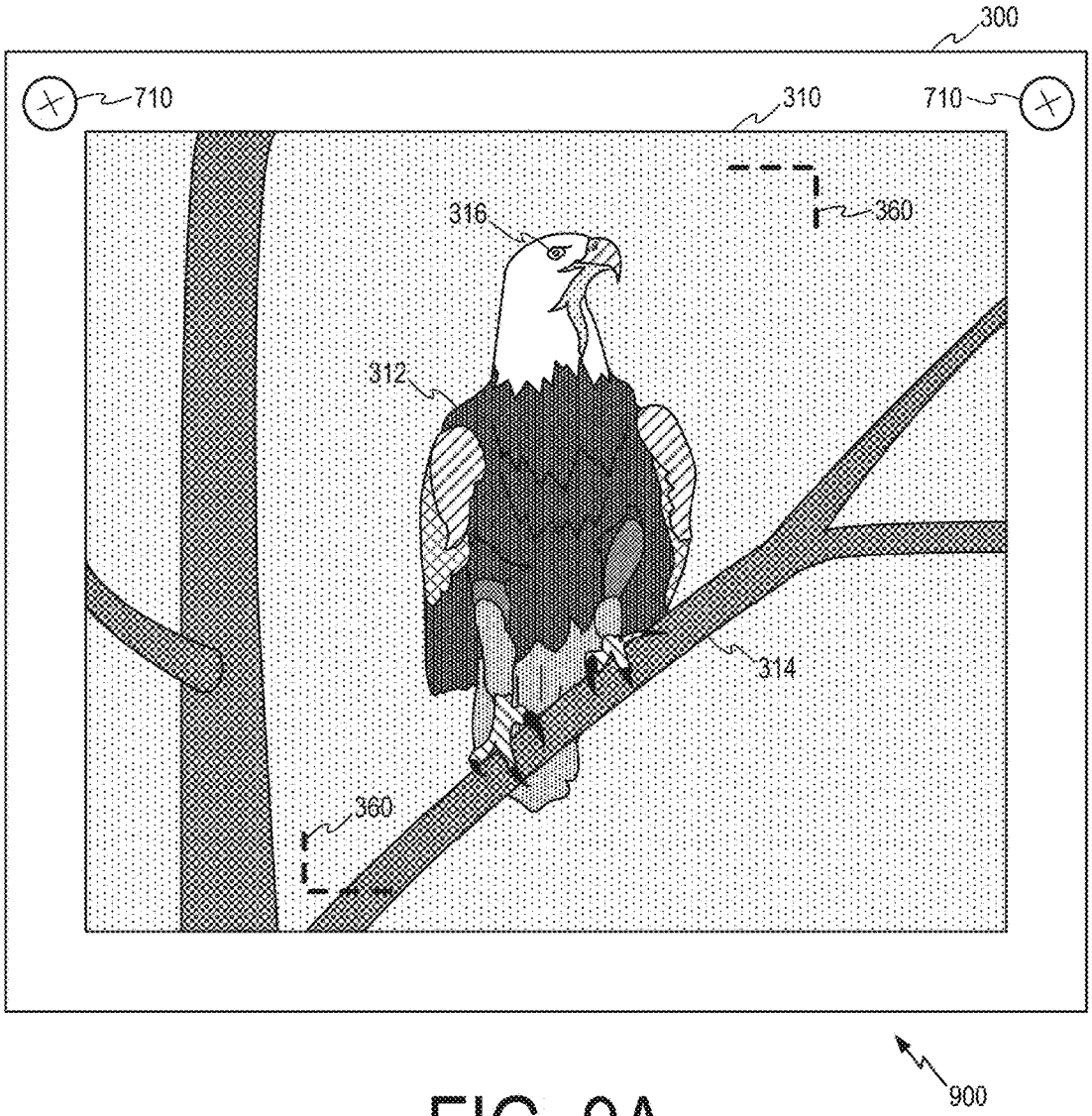
FIG. 9A illustrates a relief sculpture in a seventh stage of creation in accordance with an aspect of the disclosure.
Figure 9B:
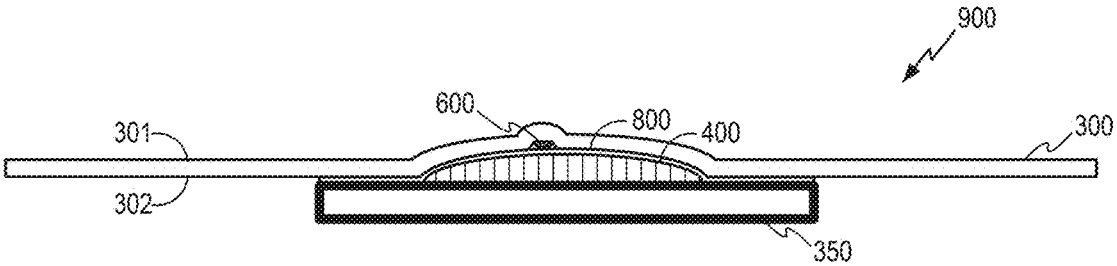
FIG. 9B illustrates a cross-sectional view of the relief sculpture depicted in FIG. 9A.

FIG. 9A illustrates a relief sculpture in a seventh stage of creation in accordance with an aspect of the disclosure. FIG. 9B illustrates a cross-sectional view of the relief sculpture depicted in FIG. 9A. As an example, the sixth stage of creation depicted in FIGS. 9A-9B may correspond to the adhering at 170 of FIG. 1 (as described above), the aligning at 274, the contacting of 276, and/or the applying of the press at 278 of FIG. 2 (as described above).

In FIGS. 9A-9B, the second surface 302 of the pliable sheet 300 and the second sculpting medium 600 on the second surface 302 of the pliable sheet 300 are adhered to the transparent plate 350, the sculpting medium 400 or both. The adhering may include the removing of air from between any of the pliable sheet 300, the transparent plate 350, the sculpting medium 400, the second sculpting medium 600, and/or the adhesive 800.

As noted above in the description of FIG. 2, the pliable sheet 300 may be adhered to the transparent plate 350 and/or sculpting medium 400 little-by-little or all at once. As an example, if the adhesive 800 is relatively quick to set, then the adhesive 800 may be applied to a relatively small portion of the transparent plate 350 and/or sculpting medium 400, and the second surface 302 of the pliable sheet 300 (or second sculpting medium 600) may be aligned and contacted to the adhesive 800 relatively quickly. As another example, if the adhesive 800 is relatively slow to dry, then the adhesive 800 may be applied to the entirety of the transparent plate 350 and/or sculpting medium 400 and the pliable sheet 300 may be aligned to the sculpting medium 400 after the second surface 302 of the pliable sheet 300 has been contacted to the entirety of the transparent plate 350 and/or sculpting medium 400. In either case, the aligning may include ensuring that the edges of the image feature selected as a subject of the relief sculpture (for example, the eagle image feature 312) correspond to the edges of the sculpting medium 400. As noted above, the pliable sheet 300 may be stretchable, and the alignment may be performed by stretching the pliable sheet 300. If the pliable sheet 300 is maintained in an immobilized state via anchoring at the anchor points 710, this may facilitate the stretching of the pliable sheet 300. Additionally or alternatively, stretching may be facilitated by adhering a portion of the pliable sheet 300, waiting for the adhesive 800 to set, and then stretching an adjacent portion of the pliable sheet 300 such that it contacts a newly-applied patch of adhesive 800.

In accordance with some aspects of the disclosure, a tool may be used to facilitate the adhering of the pliable sheet 300 to the transparent plate 350 and/or sculpting medium 400. In an example, a tool comprising a roller or roller ball may be applied to the pliable sheet 300. The tool may be made of any suitable material, for example, rubber, plastic, wood, etc. As noted above, the adhering may include removing of air from between any of the pliable sheet 300, the transparent plate 350, the sculpting medium 400, the second sculpting medium 600, and/or the adhesive 800. A rolling surface of a roller or roller ball may facilitate the removing of the air. In an example, by rolling the tool downward, air may be removed in the downward direction. The rolling surface of the tool may also be used to press the pliable sheet 300 into the adhesive 800 or portions thereof, thereby facilitating setting of the adhesive 800. The rolling surface of the tool may also be used to align or stretch the pliable sheet 300. In an example, a wide rolling surface may facilitate uniform stretching across the rolling surface.

In accordance with some aspects of the disclosure, a press may be applied to the pliable sheet 300. As noted above, the press may include a sandbag, a sheet of memory foam, or some other conforming material, and may be augmented with a weight. The press may be applied while the adhesive 800 or any portion thereof is drying and reapplied if additional adhering is performed.

In accordance with some aspects of the disclosure, some of the elements depicted in FIG. 9 constitute a relief sculpture 900. Accordingly, a relief sculpture 900 of the present disclosure may comprise the transparent plate 350, the sculpting medium 400 contacting a portion of the transparent plate 350, and the pliable sheet 300 having the first surface 301 comprising the image 310 and the second surface 302 that is adhered to the transparent plate 350, the sculpting medium 400, or both, wherein the image 310 comprises an image feature such as the eagle image feature 312 that corresponds to the selected portion 412 of the transparent plate 350 to which the sculpting medium 400 is applied. As shown in FIGS. 9A-9B, the relief sculpture 900 may also include the adhesive 800 disposed between the second surface 302 of the pliable sheet 300 and the transparent plate 350, the sculpting medium 400, or both and configured to adhere the second surface 302 of the pliable sheet 300 to the transparent plate 350, the sculpting medium 400, or both. As shown in FIG. 9B, the relief sculpture 900 may also comprise the second sculpting medium 600, which may be disposed between the second surface 302 of the pliable sheet 300 and the transparent plate 350 and/or sculpting medium 400, wherein the position of the second sculpting medium 600 corresponds to a second image feature such as the eagle eye image feature 316.

In accordance with some aspects of the disclosure, some of the elements depicted in FIG. 9 constitute a kit for creating the relief sculpture 900. Accordingly, a kit for creating a relief sculpture 900 of the present disclosure may include the transparent plate 350, the sculpting medium 400, the adhesive 800, and the pliable sheet 300 having a first surface 301 comprising the image 310, wherein the image 310 is applied to the pliable sheet 300 using one or more of direct-to-garment printing, silkscreening, thermal transfer, dye-sublimation printing, or any combination thereof. As described above, the kit may further comprise a press having an area that is at least as large as the transparent plate 350, an anchoring element configured to immobilize the pliable sheet 300, and a tool configured to facilitate the adhering of the pliable sheet 300 to the transparent plate 350 and/or sculpting medium 400 (for example, a roller or roller ball). As described in greater detail below, the kit may further comprise a frame 1110 that is configured to accommodate the transparent plate 350 having the transparent plate 350 disposed therein, a cover 1120 that is configured to be disposed in the frame 1110, and a backlight 1130 configured to transmit illumination.

Figure 10A:
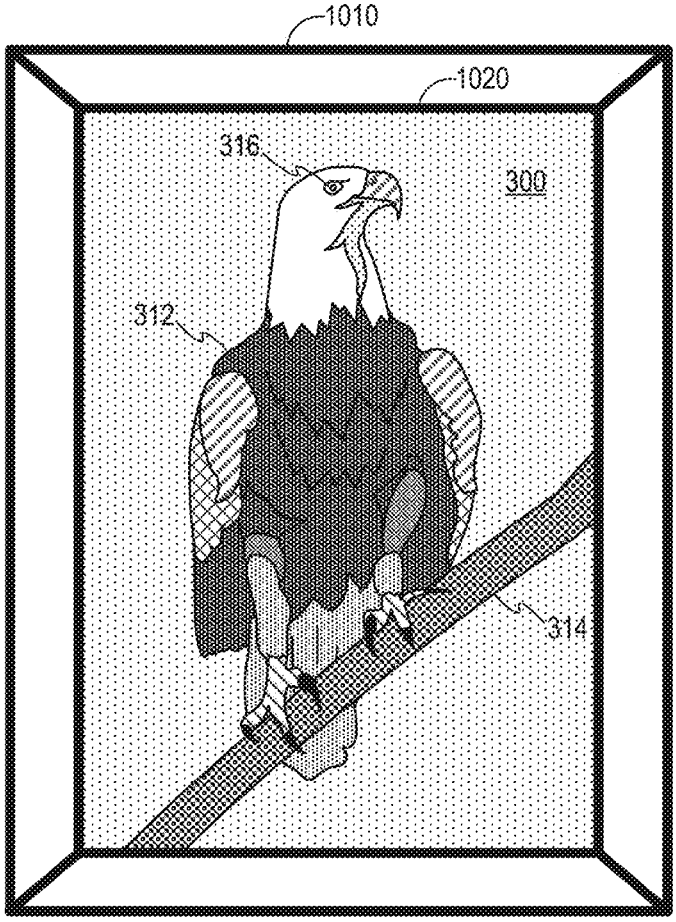
FIG. 10A illustrates a relief sculpture in an eighth stage of creation in accordance with an aspect of the disclosure.
Figure 10B:
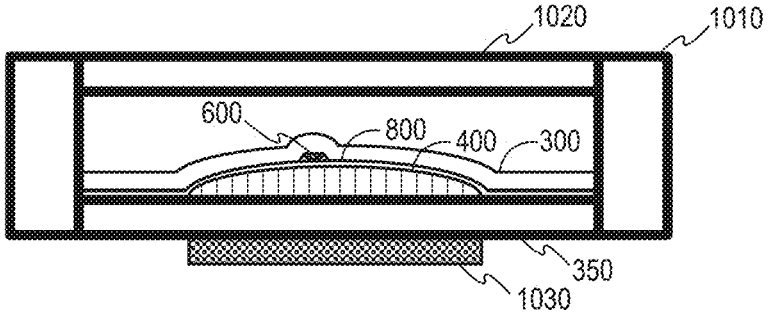
FIG. 10B illustrates a cross-sectional view of the relief sculpture depicted in FIG. 10A.

FIG. 10A illustrates a relief sculpture in an eighth stage of creation in accordance with an aspect of the disclosure. FIG. 10B illustrates a cross-sectional view of the relief sculpture depicted in FIG. 10A. As an example, the eighth stage of creation depicted in FIGS. 10A-10B may correspond to the optional covering, backlighting, and/or framing at 180 of FIG. 1 as described above.

In FIGS. 10A-10B, the transparent plate 350 has been disposed within a frame 1010 configured to accommodate the transparent plate 350 therein. As depicted in FIGS. 10A-10B, excess portions of the pliable sheet 300 that are not adhered to the transparent plate 350 or sculpting medium 400 may be trimmed away. Additionally or alternatively, the excess portions may not exist, or may be folded behind the transparent plate 350 rather than trimmed.

FIGS. 10A-10B also show a cover 1020 disposed within the frame 1010. The cover 1020 may be at least partially transparent. The cover 1020 may be of similar size and/or material as the transparent plate 350. In accordance with some aspects of the disclosure, the cover 1020 and the transparent plate 350 are identical and the frame 1010 is configured to accommodate both, as depicted in FIG. 10B. The frame 1010 may comprise fixing members (not shown) configured to hold the transparent plate 350 and/or the cover 1020 in place.

FIGS. 10A-10B also show a backlight 1030 disposed behind the transparent plate 350. The backlight 1030 may be affixed to the transparent plate 350, the frame 1010, or both. As noted above, the transparent plate 350 is at least partially transparent. Accordingly, illumination transmitted from the backlight 1030 may be transmitted through the transparent plate 350. If the artist selects transparent or partially transparent materials for the pliable sheet 300, the sculpting medium 400, the second sculpting medium 600, and/or the adhesive 800, then the illumination transmitted from the backlight 1030 may be transmitted through these elements as well.

As an example, the backlight 1030 may be a light-emitting diode (LED) that is disposed at a position behind the transparent plate 350 that corresponds to an image feature of the image 310, for example, the eagle eye image feature 316. If the artist selects transparent or partially transparent materials for the pliable sheet 300, the sculpting medium 400, the second sculpting medium 600, and the adhesive 800, then the eagle eye image feature 316 will emit light.

Optionally, an opaque material (not shown) may be selectively applied to a portion of the pliable sheet 300, the sculpting medium 400, the second sculpting medium 600, and/or the adhesive 800 that the artist does not intend to transmit light. As an example, the opaque material may be applied to portions of the pliable sheet 300, the sculpting medium 400, and the adhesive 800 that do not correspond to the eagle eye image feature 316. As a result, the illumination transmitted by the backlight 1030 may only be transmitted via the eagle eye image feature 316.

In accordance with some aspects of the disclosure, the backlight transmits illumination via a surface that is the same size as the transparent plate 350, and the opaque material (not shown) is applied to any portion of the pliable sheet 300, the sculpting medium 400, the second sculpting medium 600, and the adhesive 800 that does not correspond to a selected image feature. As an example, the image 310 may include a close-up of the moon as an image feature rather than an eagle. In this example, the artist may apply a dome-shaped sculpting medium 400 made of glass to a corresponding portion of the transparent plate 350 and may further apply opaque paint to portions of the transparent plate 350 not covered by the sculpting medium 400. As a result, the backlight 1030 would transmit light via the moon image feature.

It should be understood that any reference to an element herein using a designation such as "first," "second," and so forth does not generally limit the quantity or order of those elements. Rather, these designations may be used herein as a convenient method of distinguishing between two or more elements or instances of an element. Thus, a reference to first and second elements does not mean that only two elements may be employed there or that the first element must precede the second element in some manner While the foregoing disclosure shows various illustrative aspects, it should be noted that various changes and modifications may be made to the illustrated examples without departing from the scope defined by the appended claims. The present disclosure is not intended to be limited to the specifically illustrated examples alone. For example, unless otherwise noted, the functions, steps, and/or actions of the method claims in accordance with the aspects of the disclosure described herein need not be performed in any particular order. Furthermore, although certain aspects may be described or claimed in the singular, the plural is contemplated unless limitation to the singular is explicitly stated.

What is claimed is:

1. A method of creating a relief sculpture, comprising:

contacting a transparent plate and a first surface of a pliable sheet, the first surface of the pliable sheet comprising an image, wherein at least a portion of the image is visible through the transparent plate;

applying a sculpting medium to a portion of the transparent plate that corresponds to an image feature visible through the transparent plate; and adhering a second surface of the pliable sheet to the transparent plate, the sculpting medium, or both, such that the image feature corresponds to the sculpting medium.

2. The method of claim 1, further comprising applying the image to the pliable sheet using one or more of direct-to-garment printing, silkscreening, thermal transfer, dye-sublimation printing, or any combination thereof.

3. The method of claim 1, wherein the sculpting medium comprises clay, fabric paint, fabric ink, wood, wax, foam, glass, plastic, 3-D printing medium, or any combination thereof.

4. The method of claim 1, further comprising hardening the sculpting medium after the sculpting medium has been applied.

5. The method of claim 1, further comprising:

removing the transparent plate from contact with the first surface of the pliable sheet after the sculpting medium has been applied.

6. The method of claim 5, further comprising applying a second sculpting medium to a portion of the second surface of the pliable sheet, the portion of the second surface corresponding to a second image feature.

7. The method of claim 5, further comprising aligning the image feature with the sculpting medium prior to the adhering.

8. The method of claim 1, wherein the adhering comprises:

applying adhesive to the transparent plate, the sculpting medium, or both;

aligning the image feature with the sculpting medium; and contacting the second surface of the pliable sheet to the adhesive.

9. The method of claim 8, wherein the pliable sheet is a stretchable pliable sheet, and aligning the image feature with the sculpting medium comprises:

stretching the stretchable pliable sheet such that an outer edge of the image feature corresponds to an outer edge of the sculpting medium.

10. The method of claim 8, wherein applying adhesive comprises:

applying a first adhesive to an outer edge of the sculpting medium and a portion of the transparent plate that is near the outer edge of the sculpting medium; and applying a second adhesive to the transparent plate, the sculpting medium, or both, wherein the second adhesive has a lower water content than the first adhesive.

11. The method of claim 8, further comprising:

applying a press to the first surface of the pliable sheet until the adhesive has set.

12. The method of claim 1, further comprising:

mounting the transparent plate to a frame.

* * * * *